US005259550A

United States Patent [19]

Kuchenbecker

[11] Patent Number: 5,259,550

[45] Date of Patent: Nov. 9, 1993

[54] DECAHEDRAL TISSUE CARTON

[75] Inventor: Morris W. Kuchenbecker, Neenah, Wis.

[73] Assignee: James River Corporation of Virginia, Richmond, Va.

[21] Appl. No.: 942,616

[22] Filed: Sep. 10, 1992

[51] Int. Cl.[5] ..... B65D 5/54; B65D 85/00

[52] U.S. Cl. ..... 229/109; 221/302; 229/122

[58] Field of Search ..... 229/109, 122; 206/233, 206/494; 221/45, 302, 305, 306, 309

[56] References Cited

U.S. PATENT DOCUMENTS

| | | | |
|---|---|---|---|
| Re. 25,876 | 10/1965 | Buttery et al. . | |
| 901,695 | 10/1908 | Davis | 229/109 |
| 1,892,714 | 1/1933 | Wellman . | |
| 2,122,480 | 7/1938 | Lowey | 229/162 |
| 2,314,631 | 3/1943 | Ray . | |
| 2,320,665 | 6/1943 | Shearer | 229/162 |
| 2,593,143 | 4/1952 | Hendrick . | |
| 2,706,592 | 4/1955 | Schaller | 229/162 |
| 3,161,336 | 12/1964 | Loescher | 206/494 |
| 3,239,097 | 3/1966 | Bates et al. | 221/302 |
| 3,257,028 | 6/1966 | Metzger | 229/162 |
| 3,467,298 | 9/1969 | Wysocki . | |
| 3,638,848 | 2/1972 | Heyworth | 229/162 |
| 3,738,564 | 6/1973 | Persson . | |
| 4,289,267 | 9/1981 | Mayea . | |

FOREIGN PATENT DOCUMENTS

| | | | |
|---|---|---|---|
| 2233235 | 1/1975 | France | 229/109 |

*Primary Examiner*—Gary E. Elkins

*Attorney, Agent, or Firm*—Sixbey, Friedman, Leedom & Ferguson

[57] ABSTRACT

A paperboard tissue box having a decahedral prismatic configuration which may be rapidly fabricated using available high speed machinery providing an attractive appearance while retaining high strength is disclosed. The outer surface of the tissue box of the present invention is a decahedron having two parallel octagonal faces linked by eight rectangular lateral faces extending between the edges of the octagon and generally being disposed at right angles to the octagonal faces in the erected carton, each of the ten faces being formable by folding a unitary blank having impressed fold lines defining regions in the blank which become panels in the erected box. The panels defining the first octagonal face are formed from a single unitary octagonal region in the blank which is hingedly connected along one edge to a rectangular region while an opposing edge of the rectangular region is hingedly connected to another octagonal region which upon erection forms the other octagonal end panel defining the other octagonal face. When forming a horizontal tissue box, one of the panels extending between the two octagonal end panels will be the top panel of the carton and includes a removable oval region defined centrally therein by lines of weakness such as perforations to form an opening for removal of tissue contained in the box. Alternatively, when forming a vertical facial tissue box, one of the octagonal end panels will include an opening for gaining access to the facial tissues therein.

21 Claims, 16 Drawing Sheets

DECAHEDRAL TISSUE CARTON

TECHNICAL FIELD

The present invention relates to a container for housing facial tissue, and more particularly to a decahedral prismatic paperboard tissue container capable of being rapidly fabricated using available high speed machinery.

BACKGROUND OF THE INVENTION

Tissue boxes are often placed in rather prominent and visible positions to make the contents easily accessible. Since tissue have heretofore been packaged in rectangular cartons which are basically boring, for a more aesthetically appealing appearance, many consumers purchase various decorative over-containers which entirely encompass or hide the tissue carton. Such over-containers, which can be quite attractive, have been manufactured from wood, various plastics as well as metal and ceramic. Manufacturers quite commonly apply decorative printing to those panels of the tissue box which are intended to remain after the carton has been opened while brand identification information is confined to removable panels or overwraps meant to be discarded upon opening. No matter how fancy the covering, rectangular tissue boxes are simply inherently dull while decorative over-containers are merely expensive repositories for hiding hum-drum packaging.

In order to attempt to enhance the perception of facial tissue boxes, designer type vertical tissue boxes have been developed. However, again these boxes suffer from the same inherently dull rectangular configuration as do conventional horizontal type tissue boxes. Accordingly, the primary object of the present invention is to provide an appealing tissue box configuration which can be readily fabricated using presently available high speed machinery.

While paperboard containers have been developed spanning a variety of configurations, none have been developed for the formation of a tissue box having an attractive and appealing configuration. For example, U.S. Pat. No. 1,892,714 issued to Wellman discloses a receptacle having octagonal side walls including a hinged lid such that the receptacle may be opened and closed as necessary. The container is formed for containing non-rectangular objects in a manner such that the container can be easily opened to gain access to the contents.

U.S. Pat. No. 4,289,267 issued to Mayea discloses an eight-sided prefabricated container wherein the bottom of the container is automatically configured with the folding of the side walls. However, with such a configuration, it is virtually impossible to place printed matter on the bottom panels, and more importantly, the bottom configuration would not be appealing if visible. Further, with the vertical type tissue box, it would not be possible to form a dispensing opening in the end of the container.

Clearly, there is a need for a decorative tissue dispenser which may be readily fabricated using conventional manufacturing equipment and which does not require the use of an over-container to hide the tissue box.

SUMMARY OF THE INVENTION

As discussed above, a primary object of the present invention is to overcome the aforementioned shortcomings associated with the prior art by providing an appealing tissue box configuration which can be readily fabricated using presently available high speed machinery.

A further object of the present invention is to provide a facial tissue box which may be readily displayed without the use of over-containers to cover the facial tissue box.

Yet another object of the present invention is to provide a decorative facial tissue box which may be erected in either a horizontal configuration having an access opening in one of a plurality of side panels, or a vertical configuration having an access opening in a top panel thereof.

A further object of the present invention is to provide a decorative facial tissue box which can be manufactured with a minimal amount of waste.

These as well as additional objects of the present invention are achieved by providing a novel decahedral prismatic configuration for a paperboard tissue box which may be rapidly fabricated using available high speed machinery providing an attractive appearance while retaining high strength. Blanks for these boxes can be dovetailed with each other so that even though the design of the box strikes the eye pleasantly, little board is wasted when blanks are cut from large rolls. The outer surface of the tissue box of the present invention is a decahedron having two parallel octagonal faces linked by eight rectangular lateral faces extending between the edges of the octagon and generally being disposed at right angles to the octagonal faces in the erected carton, each of the ten faces being formable by folding a unitary blank having impressed fold lines defining regions in the blank becoming panels in the erected box. The panels defining the first octagonal face are formed from a single unitary octagonal region in the blank which is hingedly connected along one edge to a rectangular region while an opposing edge of the rectangular region is hingedly connected to another octagonal region which upon erection forms the other octagonal end panel defining the other octagonal face.

Preferably, in order to present the best appearance and when forming a horizontal facial tissue box, the panel extending between the two octagonal end panels will be the top panel of the carton and will have a removable oval region defined centrally therein by lines of weakness such as perforations to form an opening for removal of tissue contained in the box. Extending laterally from the other two sides of the top panel are a total of seven additional rectangular regions defining the panels which constitute the seven other faces in the erected box. The distribution of the number of panels extending from each side of the top panel will usually be such that the seam will be in an inconspicuous location on the lower portion of the carton, preferably at the intersection of a vertical face with an inclined panel extending between the vertical face and the bottom panel of the erected box. Hingedly connected to the rectangular lateral panels are regions constituting partially superposable support flaps defined by the edges of the blank, through scores and fold lines similar to those defining the heretofore described panels.

Alternatively, when forming a vertical facial tissue box, one of the octagonal end panels will include an opening for gaining access to the facial tissues therein. The opening may be in the form of a removable oval section as with the horizontal tissue box or may be in the form of a preformed oval opening having a sheet of transparent material overlying the opening.

Upon folding the blanks so that the lateral panels define an octagonal generalized cylinder ("octagonal prism"), large areas of the support flaps become superposable over each other so that they may be adhesively joined to each other thereby locking together at least both of the assemblies of three lateral panels to form relatively rigid tray or traylike side assemblies to the box, the two traylike sides opening inwardly toward and adjoining the rectangular prismatic region defined between the top and bottom panels with the entire assembly, (two trays joined by top and bottom panel) defining an octagonal rectangular prism, the interior of which receives the tissue. Optionally, support flaps attached to the bottom panel may also be partially superposable to further reinforce the carton by locking the two lateral traylike side assemblies together. Prior to loading the tissue, the support flaps attached at one end of their respective lateral panels panel may be folded inwardly, the octagonal end panel adhesive bonded to the inwardly folded superposed support flaps to form a rigid end to the octagonal prism. After the tissues are loaded, the procedure is repeated at the other end, forming an attractive, rigid container.

These as well as additional advantages of the present invention will become apparent from the following detailed description of the present invention when read in light of the several figures.

DETAILED DESCRIPTION OF THE PREFERRED EMBODIMENT

Figure 1:
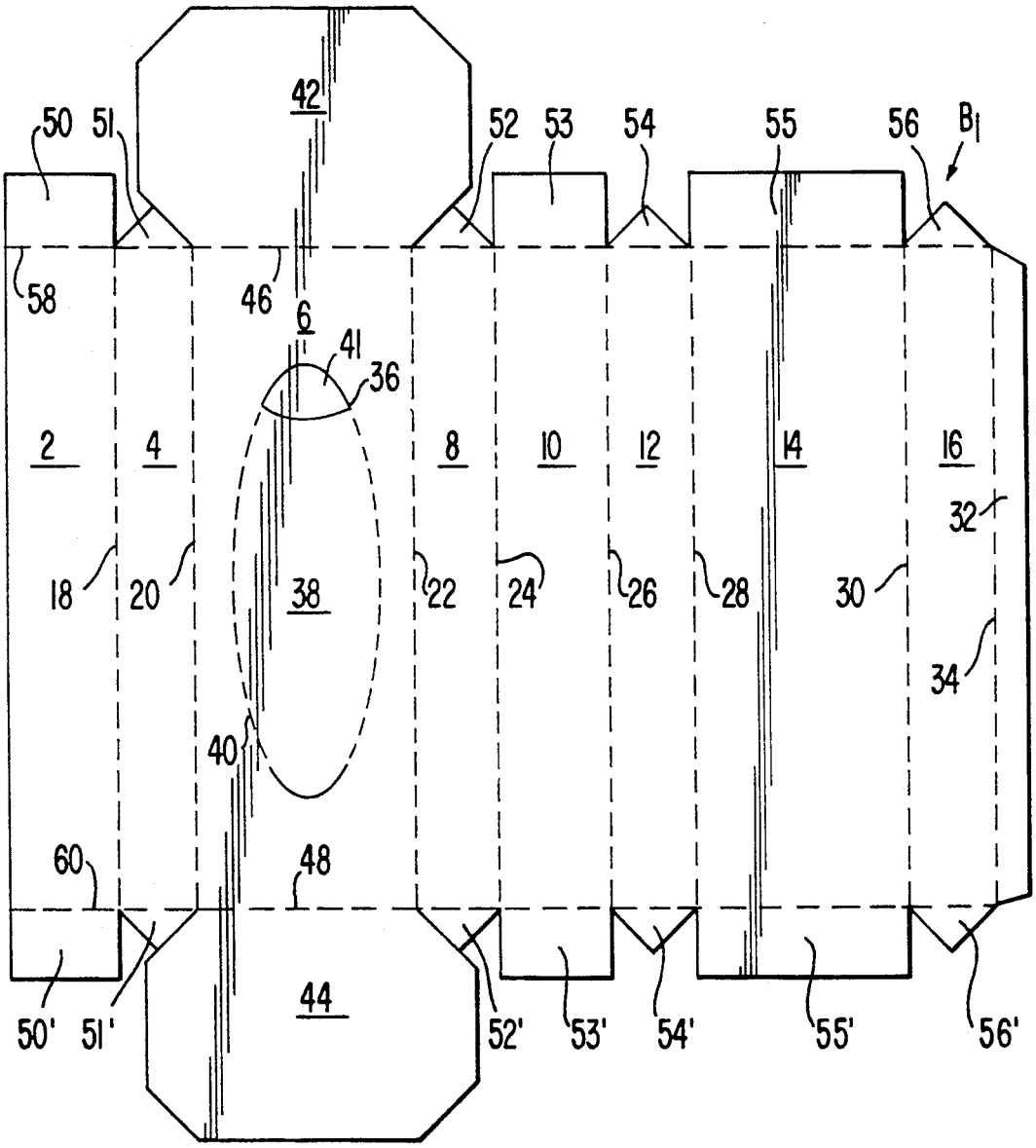
FIG. 1 is a plan view of a paperboard blank used in forming a container in accordance with a preferred embodiment of the present invention.
Figure 2:
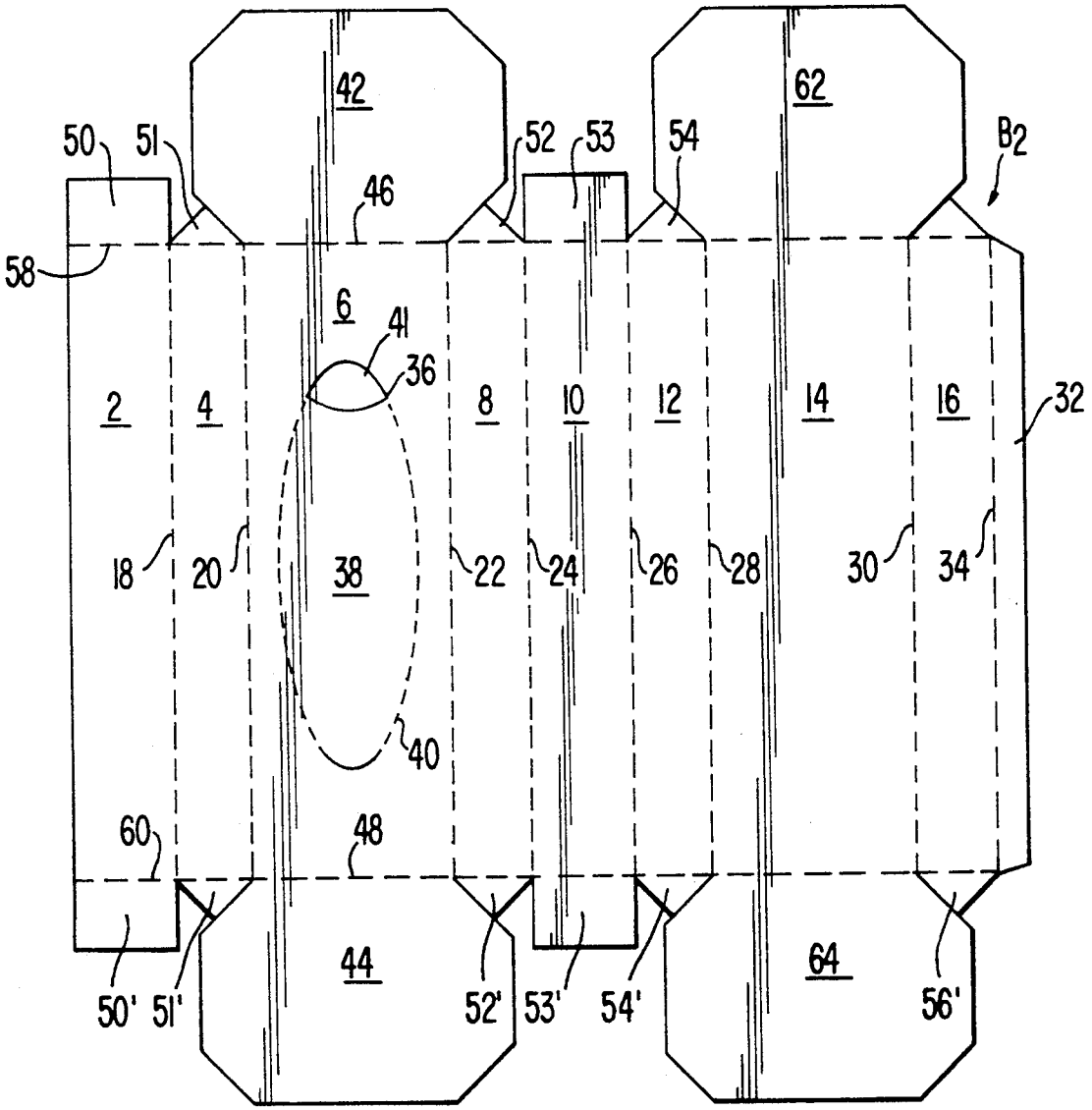
FIG. 2 is a plan view of an alternative paperboard blank used in forming the container in accordance with the preferred embodiment of the present invention.
Figure 3:
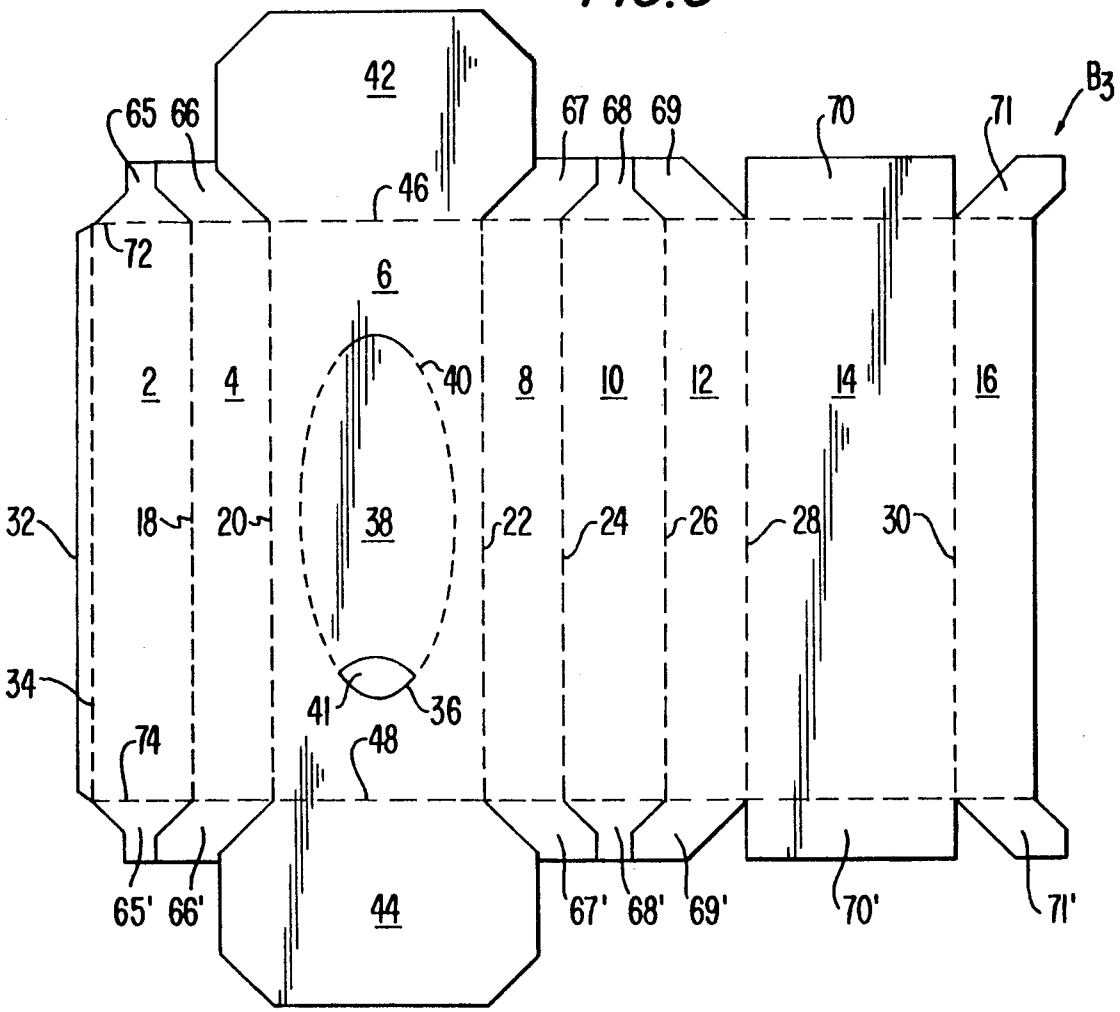
FIG. 3 is a plan view of yet another alternative paperboard blank used in forming the container in accordance with the preferred embodiment of the present invention.
Figure 5:
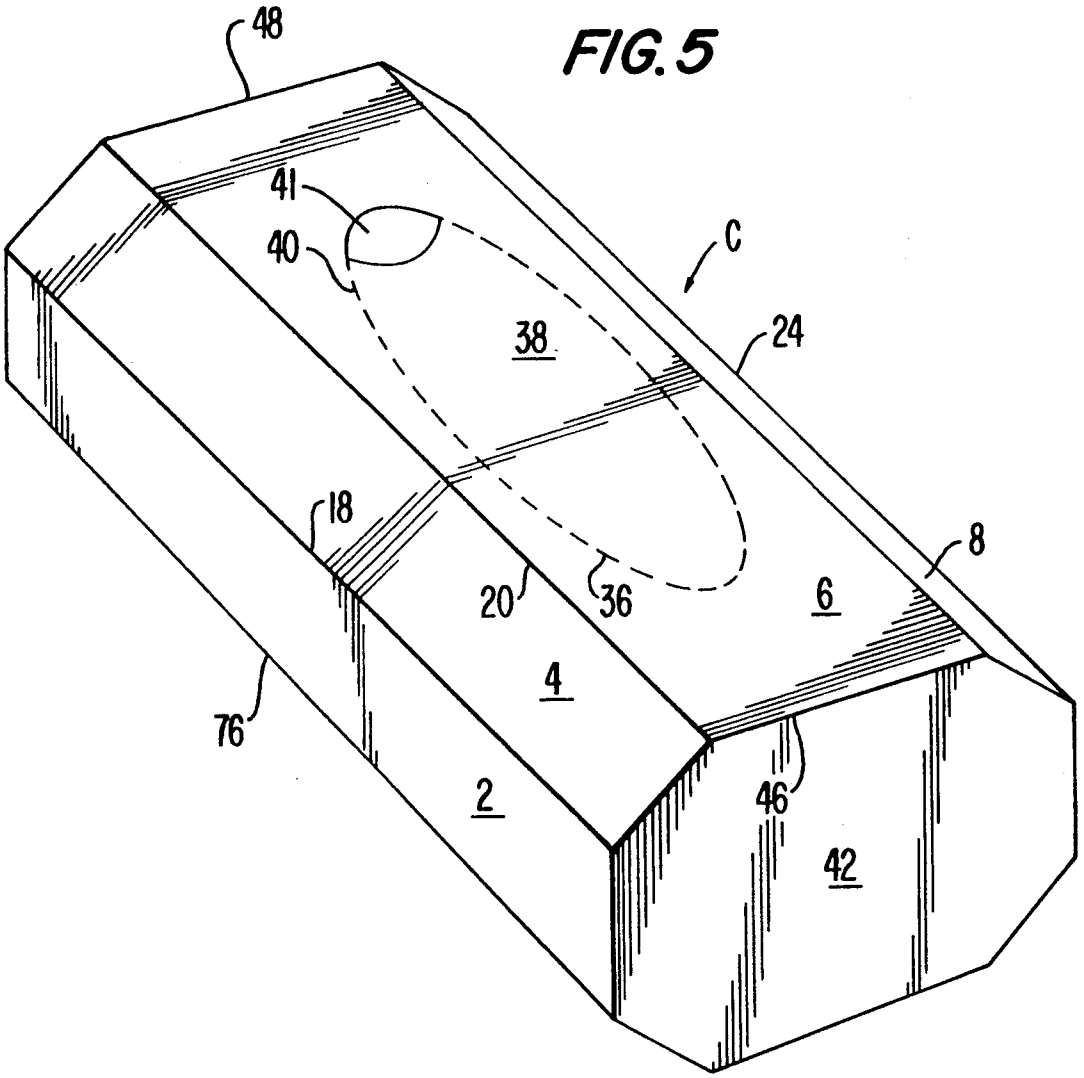
FIG. 5 is a perspective view of the container in accordance with the preferred embodiment of the present invention.

Referring now to FIGS. 1, 2 and 3, there is shown carton blanks $B_1$, $B_2$ and $B_3$ for forming the carton illustrated in FIG. 5. Due to the similarities of the several blanks, like elements will be referred to throughout the several figures with like reference numerals. The blank $B_1$ illustrated in FIG. 1 includes a plurality of side panels 2, 4, 6, 8, 10, 12, 14, and 16 each being interconnected with one another by way of substantially parallel crease score fold lines 18, 20, 22, 24, 26, 28 and 30. A sealing flap 32 is also hingedly connected to the last side panel 16 by way of crease score fold line 34 which extends substantially parallel to crease score fold line 30. With the embodiment illustrated in FIG. 1 as well as those illustrated in FIGS. 2 and 3, the side panel 6 includes an access opening 36 which is formed in what results in the top panel of the facial tissue container when the blank $B_1$ is formed into such container. The access opening 36 is temporarily covered by a removable portion 38 of the top panel 6 which is defined by a substantially continuous line of weakness 40. Also, a cut-out 41 may be provided to aid in the removal of portion 38 and the opening of the carton. This line of weakness may be in the form of a single line of perforations in combination with knife cuts as illustrated in FIG. 1, or in the form of staggered perforations combined with knife cuts or any other suitable means for allowing the removal of the portion 38 of the top panel 6 from the container by the consumer.

Octagonal end panels 42 and 44 are hingedly connected to respective ends of the side panel 6 by way of crease score fold lines 46 and 48 respectively. In addition to the end panels 42 and 44 and the flaps 50–56 and 50'–56' are hingedly connected to respective ends of the several side panels by way of continuous crease score fold lines 58 and 60. The end flaps cooperate with one another to underlie and support each of the respective octagonal end panels 42 and 44 when the blank $B_1$ is erected into the carton as illustrated in FIG. 5.

As with the remaining embodiments, the blank illustrated in FIG. 1 is preferably formed of a paperboard material. This paperboard material may be coated with a polyethylene coating if desired and an outer surface of the blank $B_1$ is preferably printed with a decorative pattern for display by the consumer. Additionally, trademark or trade name information may be printed on an outer surface of the removable portion 38 which can be readily removed by the consumer.

The blank $B_2$ illustrated in FIG. 2 is essentially identical to that set forth in FIG. 1 with the exception of the end flaps 55 and 55' being replaced by octagonal end panels 62 and 64 which are substantially identical to the octagonal end panels 42 and 44. With the construction of the blank $B_2$ illustrated in FIG. 2 into the carton illustrated in FIG. 5, the octagonal end panels 62 and 64 are folded inwardly in a manner identical to that of the end flaps with the octagonal end panels 42 and 44 overlying and being adhered to an outer surface of the octagonal end panels 62 and 64. In doing so, the resultant container will be more structurally sound and can be used for heavy duty tissues or paper towels. However, as will be discussed in greater detail hereinbelow, forming the container in such a manner results in the use of additional paperboard material.

Referring now to FIG. 3, yet another embodiment of the present invention illustrating a blank for forming a facial tissue carton in accordance with the present invention is illustrated. The blank $B_3$ is similar in most regards to the blank illustrated in FIG. 1 and includes side panels 2, 4, 6, 8, 10, 12, 14 and 16 which are integrally formed from a single sheet of paperboard material and divided by substantially parallel crease score fold lines 18, 20, 22, 24, 26, 28 and 30. With this embodiment; however, the sealing flap 32 is hingedly connected by way of crease score fold line 34 to side panel 2, the crease score fold line 34 being substantially parallel to the crease score fold line 18. Similarly, the blank $B_3$ includes an access opening 36 having a removable portion 38 defined by the line of weakness 40 which may be readily removed by the consumer in order to gain access to the facial tissues contained within a container formed from the blank $B_3$.

Further, as with the previous embodiments, the blank $B_3$ includes octagonal end panels 42 and 44 which are hingedly connected to the side panel 6 which forms a top panel of a resultant container, by way of crease score fold lines 46 and 48 respectively. However, unlike the previous embodiments, the blank $B_3$ includes end flaps 65–71 and 65'–71', with the end flaps 65–71 being substantially mirror images of the end flaps 65'–71'. The end flaps 65, 65' and 68, 68' being diecut in a manner such that the end flaps 66, 66', 67, 67', 69, 69' and 71, 71' cooperate to overlie one another in the manner illustrated in FIG. 6 to form a supporting structure about the periphery of the octagonal end panels 42 and 44 with the end panels 42, 44 being reliably adhered thereto.

Figure 4:
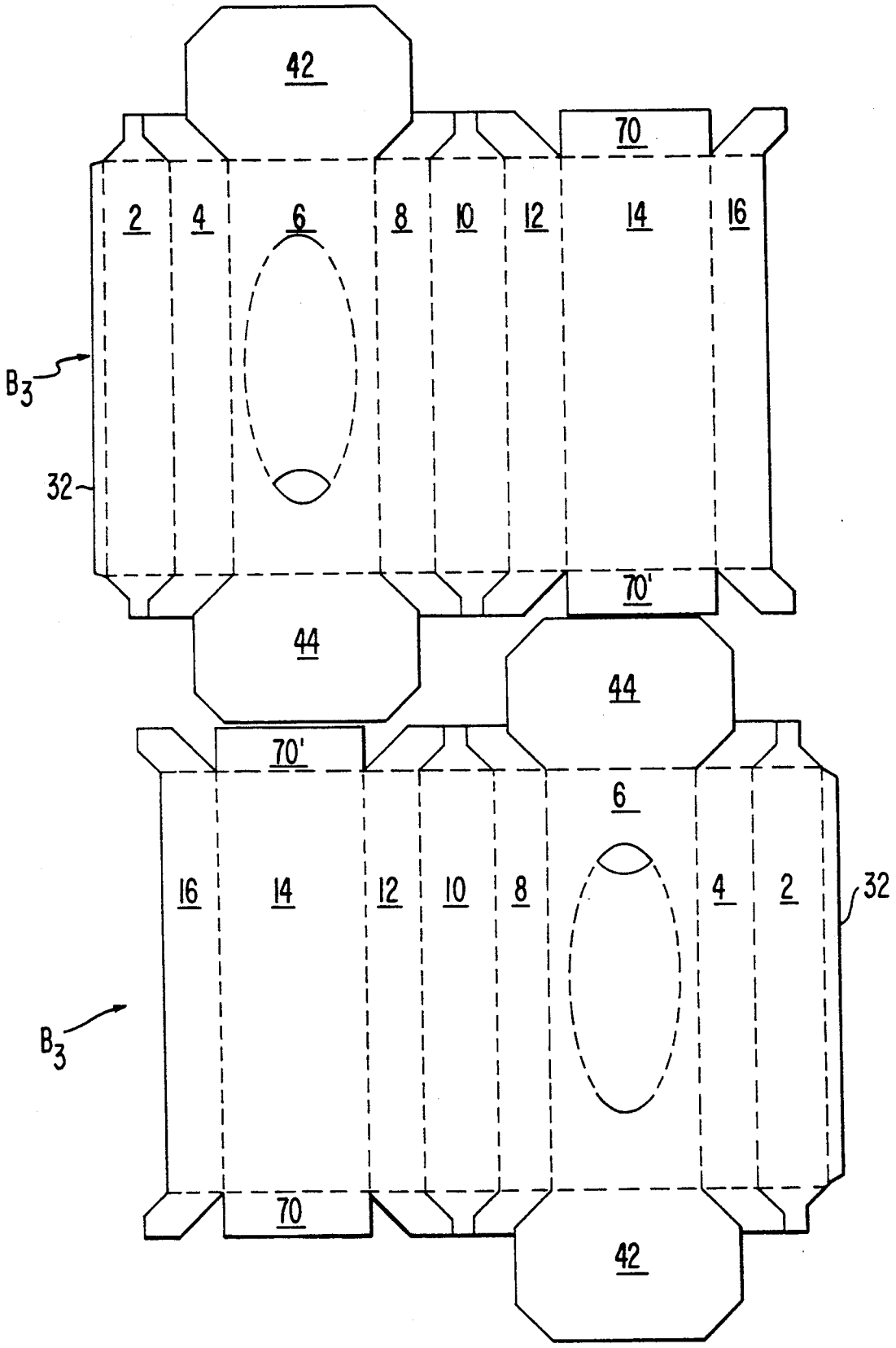
FIG. 4 is a plan view of two paperboard blanks of the type illustrated in FIG. 3 interconnected with one another during their fabrication.

With reference to FIG. 4, two blanks $B_3$ are illustrated in an orientation which is preferred during the fabrication of the paperboard blanks. As is illustrated therein, when forming a plurality of paperboard blanks from a single sheet of a determinate or indeterminate length, the paperboard blanks $B_3$ are inverted with respect to one another such that respective octagonal end panels 44 of adjacent blanks abut the end flaps 70' of the adjacent blank. In doing so, the amount of paperboard material wasted during the fabrication of the blanks $B_3$, can be minimized in order to manufacture such blanks in a cost-effective manner.

FIG. 5 illustrates the resultant carton C which is formed from any one of the panels $B_1$–$B_3$. It can be noted that the side panel 6 which forms the top panel is of a width which is greater than that of the remaining side panels. This is the case such that a larger access opening 36 may be provided in the top panel as well as providing a correspondingly wide base which stabilizes the facial tissue container when placed on a flat surface. While the container C depicted in FIG. 5 includes four substantially equal side panels 4, 8, 12 and 16 diametrically opposed to one another, two other substantially equal side panels 2 and 10 diametrically opposed to one another and two equal but larger side panels 6 and 14, the side panels may be dimensioned in any suitable manner in order to provide the requisite decorative container. Preferably, in order to present the best appearance possible and when forming a horizontal facial tissue container as illustrated in FIG. 5, the panel 6 extending between octagonal end panels 42 and 44 will be the top panel of the container and will include the access opening 36 and removable portion 38. Extending laterally from the other two sides of the top panel are, as illustrated in FIGS. 1–3, a total of seven additional rectangular regions which form the remaining side panels 2, 4, 8, 10, 12, 14 and 16. The distribution and number of panels extending from each side of the top panel are provided such that the seam which is formed by the adhesion of the sealing flap 32 to an inside surface of the side panel 16 is in an inconspicuous location on the lower portion of the container. Preferably, the seam 76 is positioned at the intersection of what constitutes a vertical face, that being side panel 2 and an incline panel, that being side panel 16 (not illustrated in FIG. 5), extending between the vertical face and the bottom panel 14 of the erected container.

Figure 6:
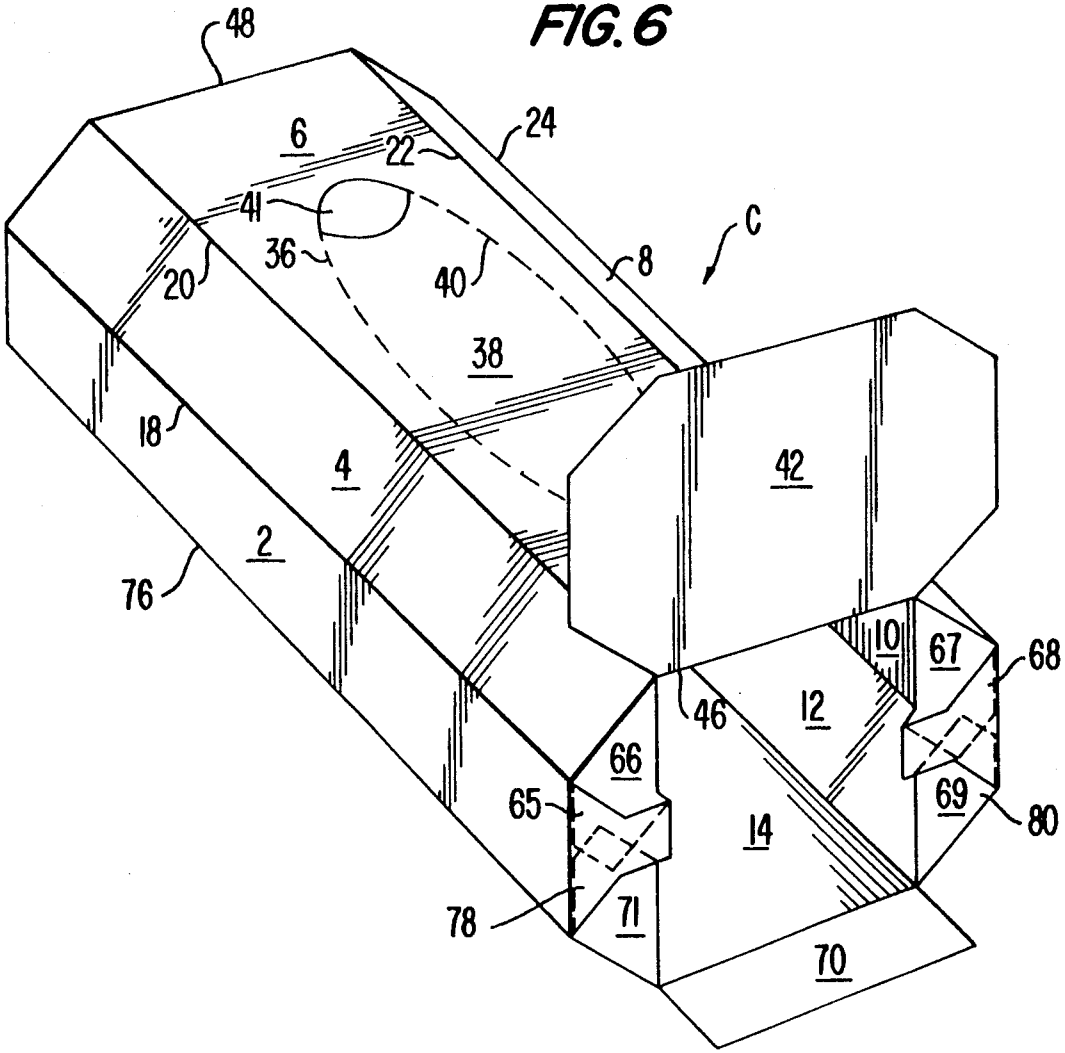
FIG. 6 is a perspective view of the container of FIG. 5 having an open end for receiving facial tissues therein.

Referring now to FIG. 6, the carton C is illustrated in a substantially formed condition which is that condition in which the contents of the container are positioned therein. As can be seen from the open end of the container C, the end flaps 65, 66 and 71 cooperate to form a first support structure 78, with the end flaps 67, 68 and 69 cooperating to form a second support structure 80. When forming the support structure 78, the end flaps 66 and 71 are initially folded inwardly to a plane substantially perpendicular to their respective side panels 4 and 16. Once in this condition, the end flap 65 is folded substantially perpendicular to the side panel 2 and adhesively secured to the contacting surface of the end flaps 66 and 71. Similarly, the support structure 80 is formed by initially folding the end flaps 67 and 69 inwardly to a position substantially perpendicular their respective sidewalls 8 and 12 and overfolding the end flap 68 and adhering end flap 68 thereto. The other end of the carton C is formed in a manner similar to this end. Once the contents are positioned within the container, the remaining end flap 70 is folded inwardly to a position substantially perpendicular to the side panel or bottom panel 14 and subsequently the octagonal end panel 42 is overfolded substantially perpendicular to the side panel or top panel 6 and adhesively secured to the support structures 78 and 80 as well as an outer surface of the end flap 70. By interconnecting the end flaps in a manner illustrated in FIG. 6, the resultant container more efficiently resists any compressive forces in the vertical direction.

Figure 7:
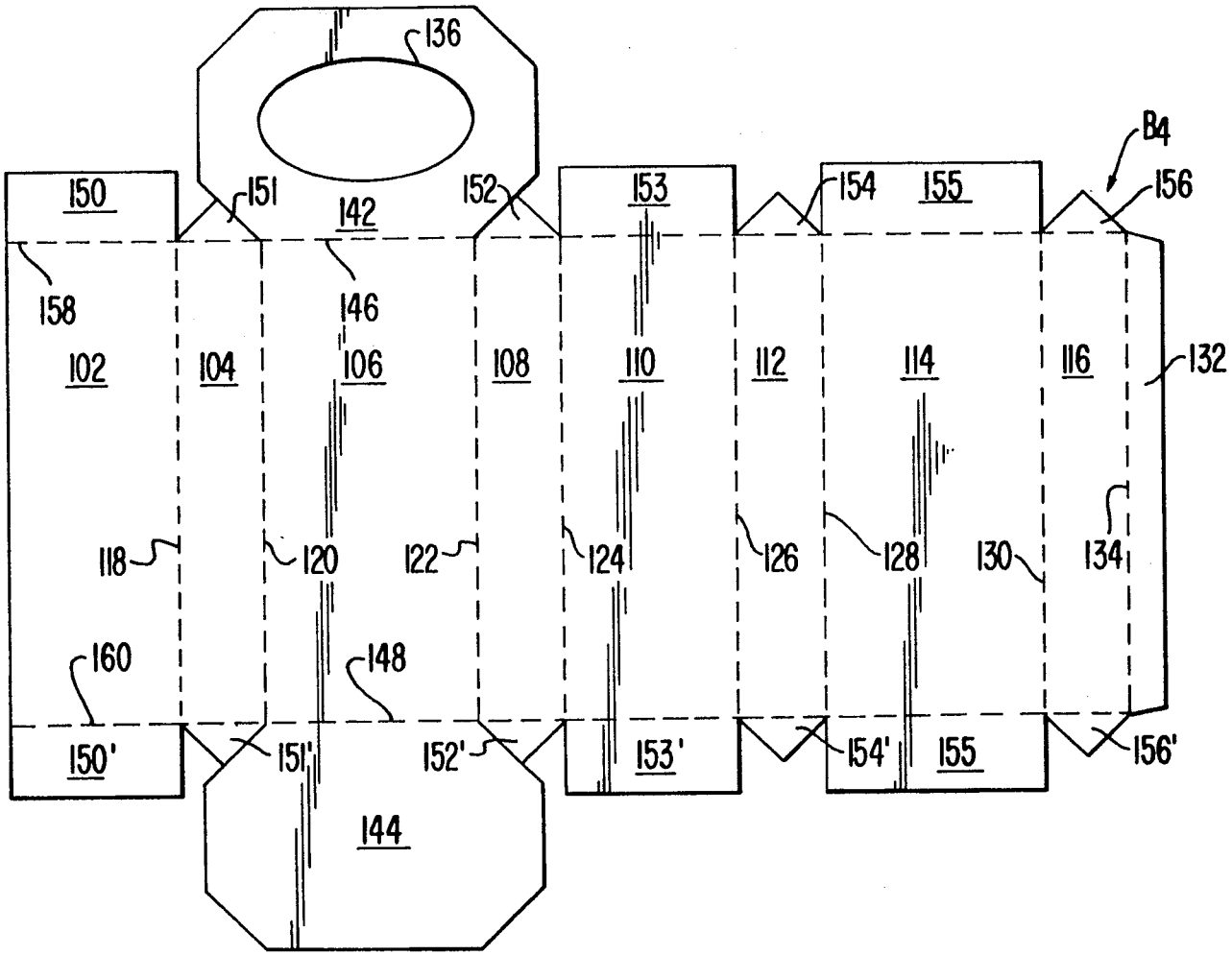
FIG. 7 is a plan view of a paperboard blank used in forming a container in accordance with an alternative embodiment of the present invention.
Figure 8:
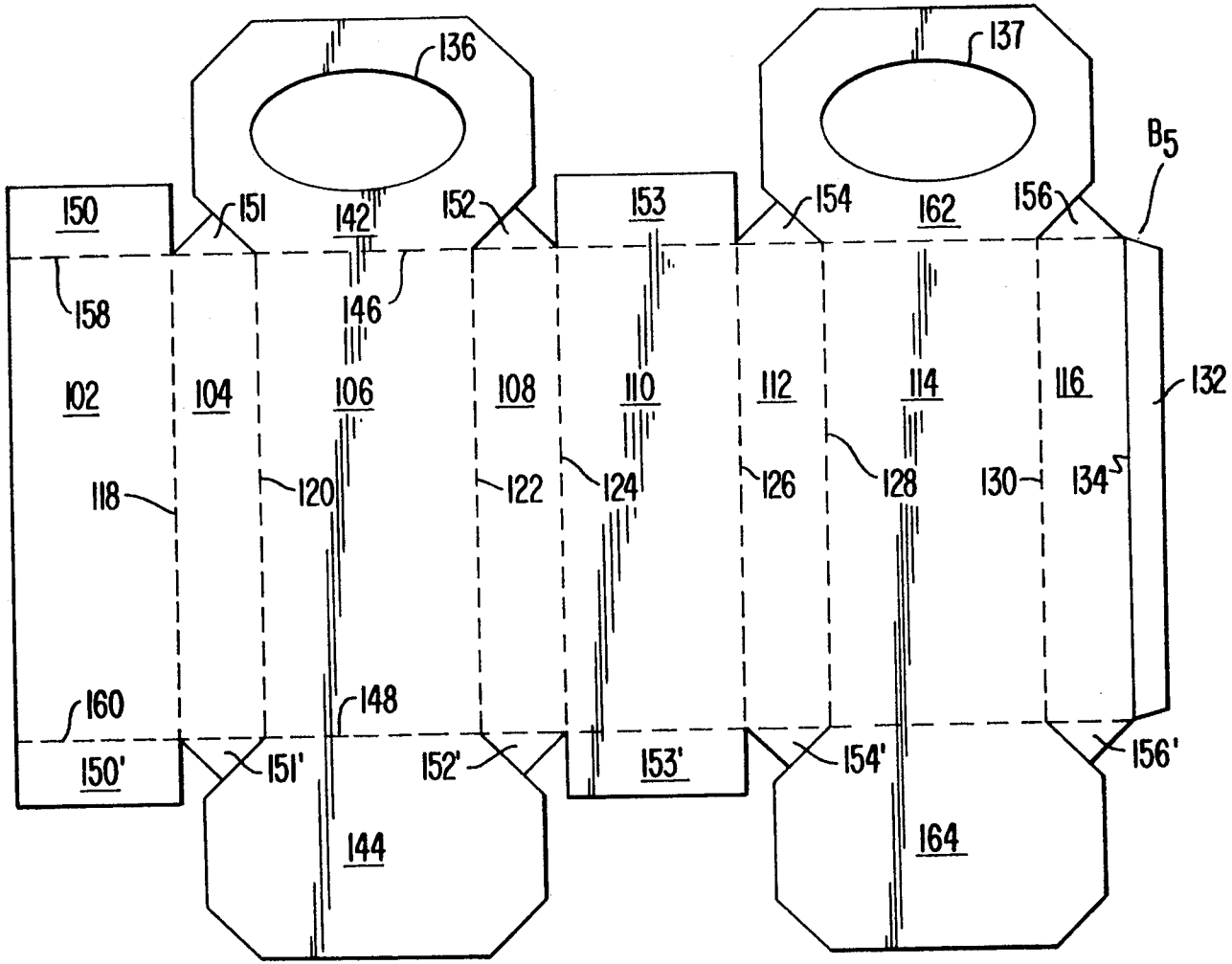
FIG. 8 is a plan view of an alternative paperboard blank used in forming the container in accordance with the alternative embodiment of the present invention.
Figure 9:
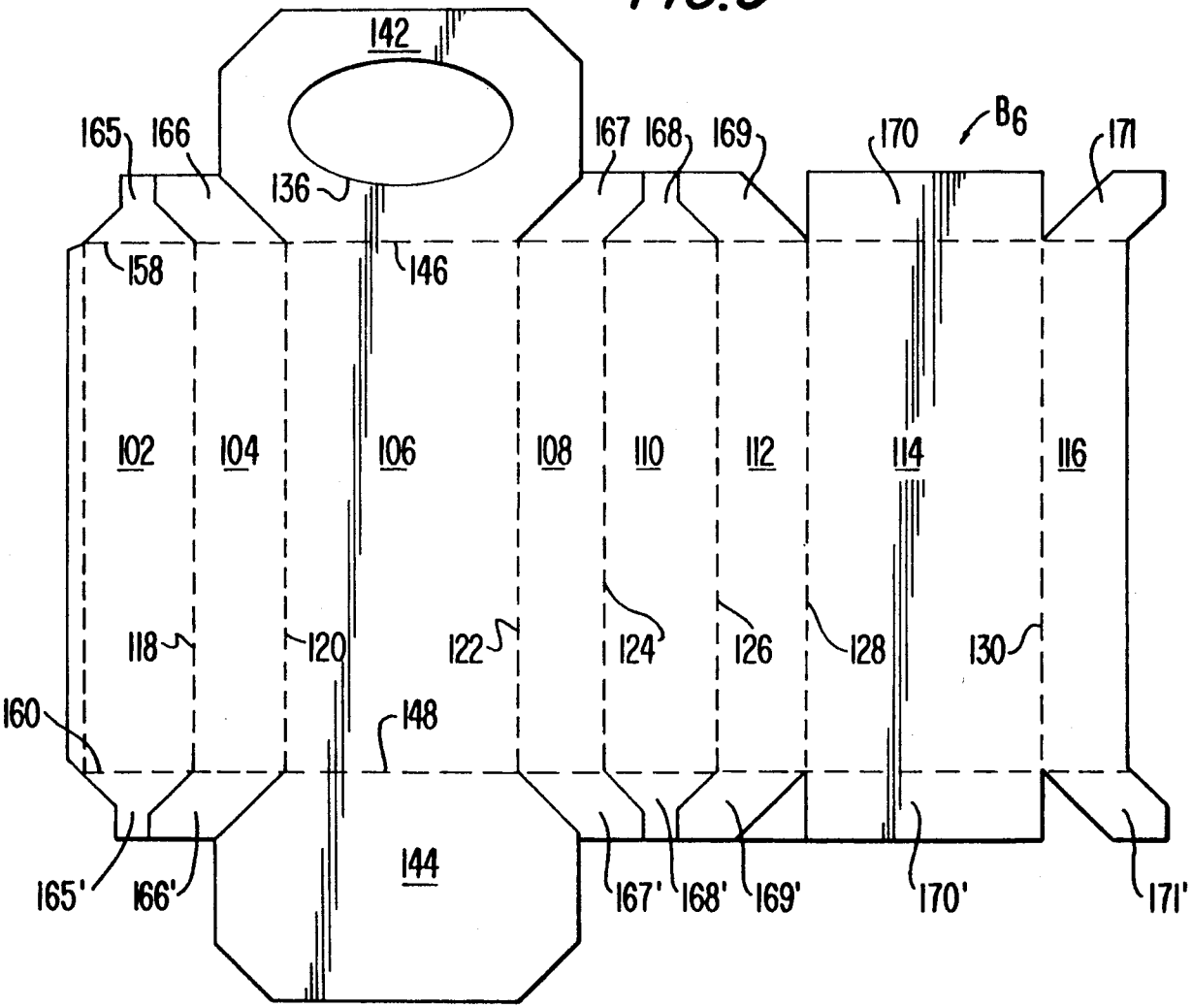
FIG. 9 is a plan view of yet another alternative paperboard blank used in forming the container in accordance with the alternative embodiment of the present invention.
Figure 11:
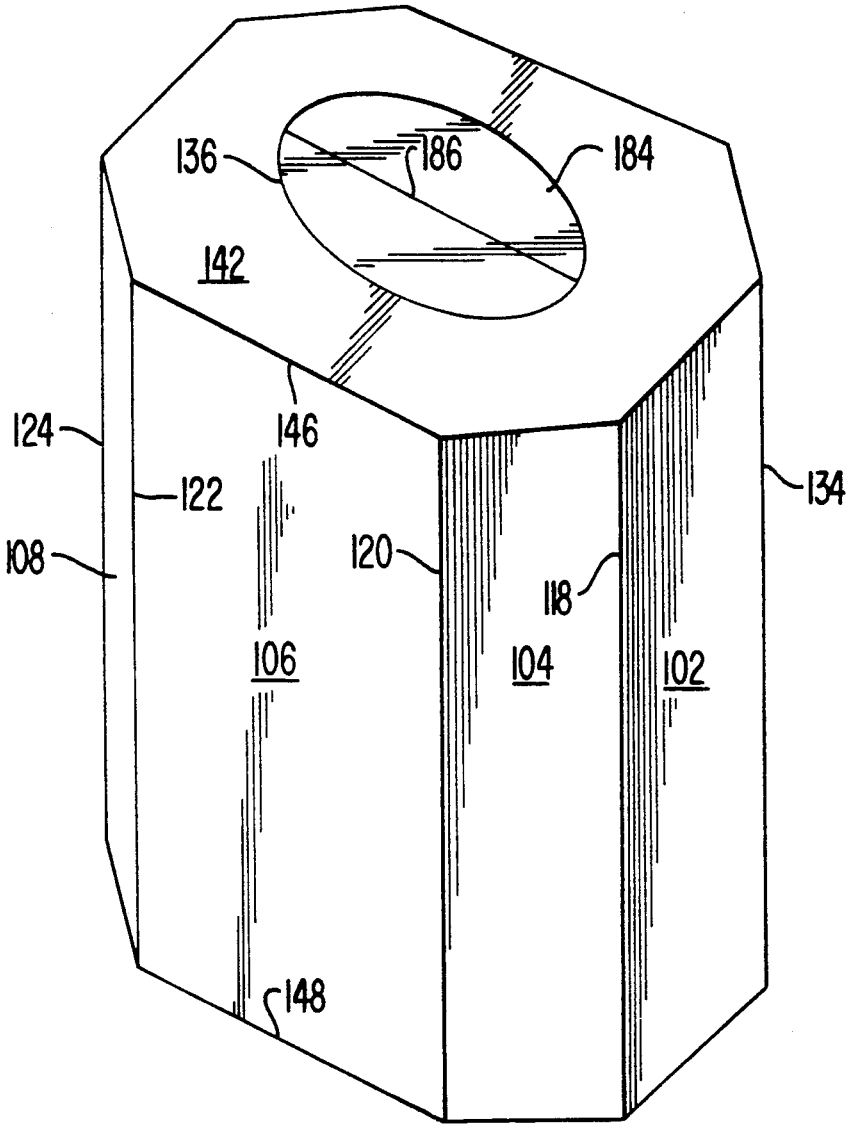
FIG. 11 is a perspective view of the container in accordance with the alternative embodiment of the present invention.

Referring now to FIGS. 7, 8 and 9, there is shown carton blanks $B_4$, $B_5$ and $B_6$ for forming the carton C illustrated in FIG. 11. Due to the similarities of the several blanks, like elements will be referred to throughout the several figures with like reference numerals. The blank $B_4$ illustrated in FIG. 7 includes a plurality of side panels 102, 104, 106, 108, 110, 112, 114 and 116 each being interconnected with one another by way of substantially parallel crease score fold lines 118, 120, 122, 124, 126, 128 and 130. A sealing flap 132 is also hingedly connected to the last side panel 116 by way of crease score fold line 134 which extends substantially parallel to crease score fold line 130.

Octagonal end panels 142 and 144 are hingedly connected to respective ends of the side panel 106 by way of crease score fold lines 146 and 148 respectively. In addition to the end panels 142 and 144, end flaps 150–156 and 150'–156' are hingedly connected to respective ends of the several side panels by way of continuous crease score fold lines 158 and 160. The end flaps cooperate with one another to underlie and support each of the respective octagonal end panels 142 and 144 when the blank $B_4$ is erected into the carton as illustrated in FIg. 11. Additionally, with the embodiment illustrated in FIG. 7 as well as those illustrated in FIGS. 8 and 9, the octagonal end panel 142 includes an access opening 136 which is formed in what results in the top panel of the facial tissue container when the blank $B_4$ is formed into such container. The access opening 136 may be covered by a transparent film 184, the significance of which will be discussed in greater detail hereinbelow.

As with the previous embodiments, the blank illustrated in FIGS. 7, 8 and 9 are preferably formed of a paperboard material. This paperboard material may be coated with a polyethylene coating if desired and an outer surface of the blank is preferably printed with a decorative pattern for display by the consumer. Trademark or trade name information may be printed on a substantially transparent cover film which covers the access opening 136 and which can be readily removed by the consumer prior to use of the container.

The blank $B_5$ illustrated in FIG. 8 is essentially identical to that set forth in FIG. 1 with the exception of the end flaps 155 and 155' being replaced by octagonal end panels 162 and 164 which are substantially identical to the octagonal end panels 142 and 144 respectively. With the construction of the blank $B_5$ illustrated in FIG. 8 into the carton illustrated in FIG. 11, the octagonal end panels 162 and 164 are folded inwardly in a manner similar to that of the end flaps with the octagonal end panels 142 and 144 overlying and being adhered to an outer surface of the octagonal end panels 162 and 164. In doing so, the resultant container will be more structurally sound and can be used for heavy duty tissues or paper towels if desired. However, as will be discussed in greater detail hereinbelow, forming the container in such a manner results in the use of additional paperboard material. It should be noted that octagonal end panel 162 includes an access opening 137 which is identical to that of access opening 136. These openings align with one another when the container is formed.

Referring now to FIG. 9, yet another embodiment of the present invention illustrating a blank for forming a facial tissue container in accordance with the present invention is illustrated. The blank $B_6$ is similar in most regards to the blank illustrated in FIG. 7 and includes side panels 102, 104, 106, 108,110, 112, 114 and 116 which are integrally formed from a single sheet of paperboard material and divided by substantially parallel crease score fold lines 118, 120, 122, 124, 126, 128 and 130. As with the blank $B_3$, the sealing flap 132 is hingedly connected by way of crease score fold line 134 to side panel 102, the crease score fold line 134 being substantially parallel to the crease score fold line 118. Further, as with the previous embodiments, the blank $B_6$ includes octagonal end panels 142 and 144 which are hingedly connected to the side panel 106 by way of crease score fold lines 146 and 148 respectively, with octagonal end panel 142 ultimately forming a top panel of a resultant container. Similarly, the blank $B_6$ includes an access opening 136 such that the consumer can gain access to the facial tissues contained within a container formed from the blank $B_6$. However, unlike the previous embodiments, the blank $B_6$ includes end flaps 165–171 and 165'–171', with the end flaps 165–171 being substantially mirror images of the end flaps 165'–171'. The end flaps 165, 165' and 168, 168' being diecut in a manner such that the end flaps 166, 166', 167, 167', 169, 169' and 171, 171' cooperate to overlie one another in the manner illustrated in FIG. 12 to form a supporting structure about the periphery of the octagonal end panels 142 and 144 with the octagonal end panels 142, 144 being reliably adhered thereto.

Figure 10:
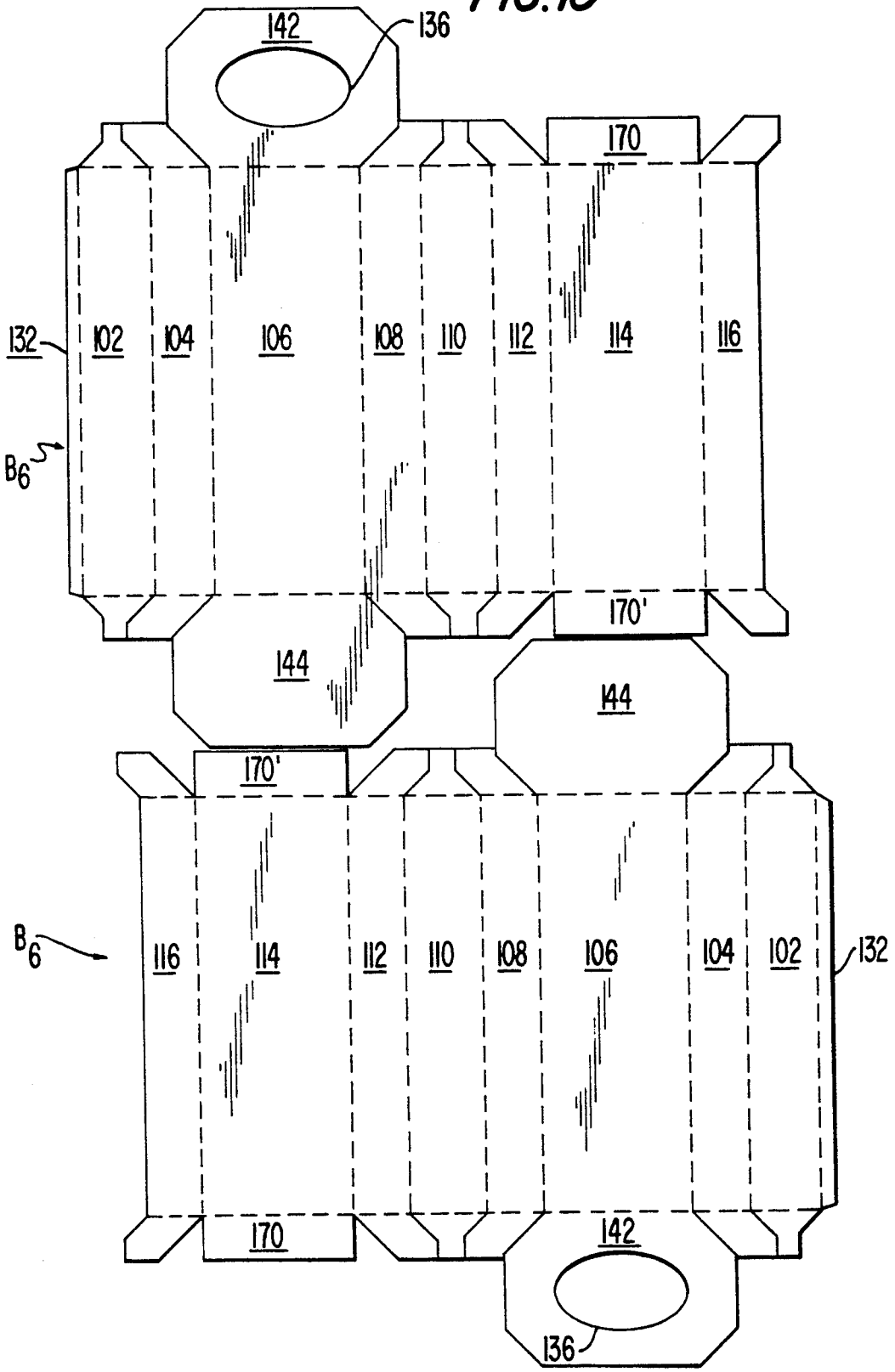
FIG. 10 is a plan view of two paperboard blanks of the type illustrated in FIG. 9 interconnected with one another during their fabrication.

With reference to FIG. 10, two blanks $B_6$ are illustrated in an orientation which is preferred during the fabrication of the paperboard blanks. As is illustrated therein, when forming a plurality of paperboard blanks from a single sheet of a determinate or indeterminate length, the paperboard blanks $B_6$ are inverted with respect to one another such that respective octagonal end panels 144 of adjacent blanks abut the end flaps 170' of the adjacent blank. In doing so, the amount of paperboard material wasted during the fabrication of the blanks $B_6$ is minimized as with those blanks $B_3$ illustrated in FIG. 4, in order to manufacture such blanks in a cost-effective manner.

FIG. 11 illustrates the resultant carton C' which is formed from any one of the panels $B_4$–$B_6$. It can be noted that the side panels are of varying widths, with side panels which diametrically oppose one another being of the same width. Preferably, in order to present the best appearance possible and when forming a vertical facial tissue container as illustrated in FIG. 11, the panel 106 extending between octagonal end panels 142 and 144 is positioned at a side of the finished container when looking at the container from what is to be the front thereof. Extending laterally from the other two sides of the panel 106 are, as illustrated in FIGS. 1–3, a total of seven additional rectangular regions which form the remaining side panels 102, 104, 108, 110, 112, 114 and 116. The distribution and number of panels extending from each side of the panel 106 are provided such that the seam which is formed by the adhesion of the sealing flap 132 to an inside surface of the side panel 102 is in an inconspicuous location on a side or rear portion of the container.

Figure 12:
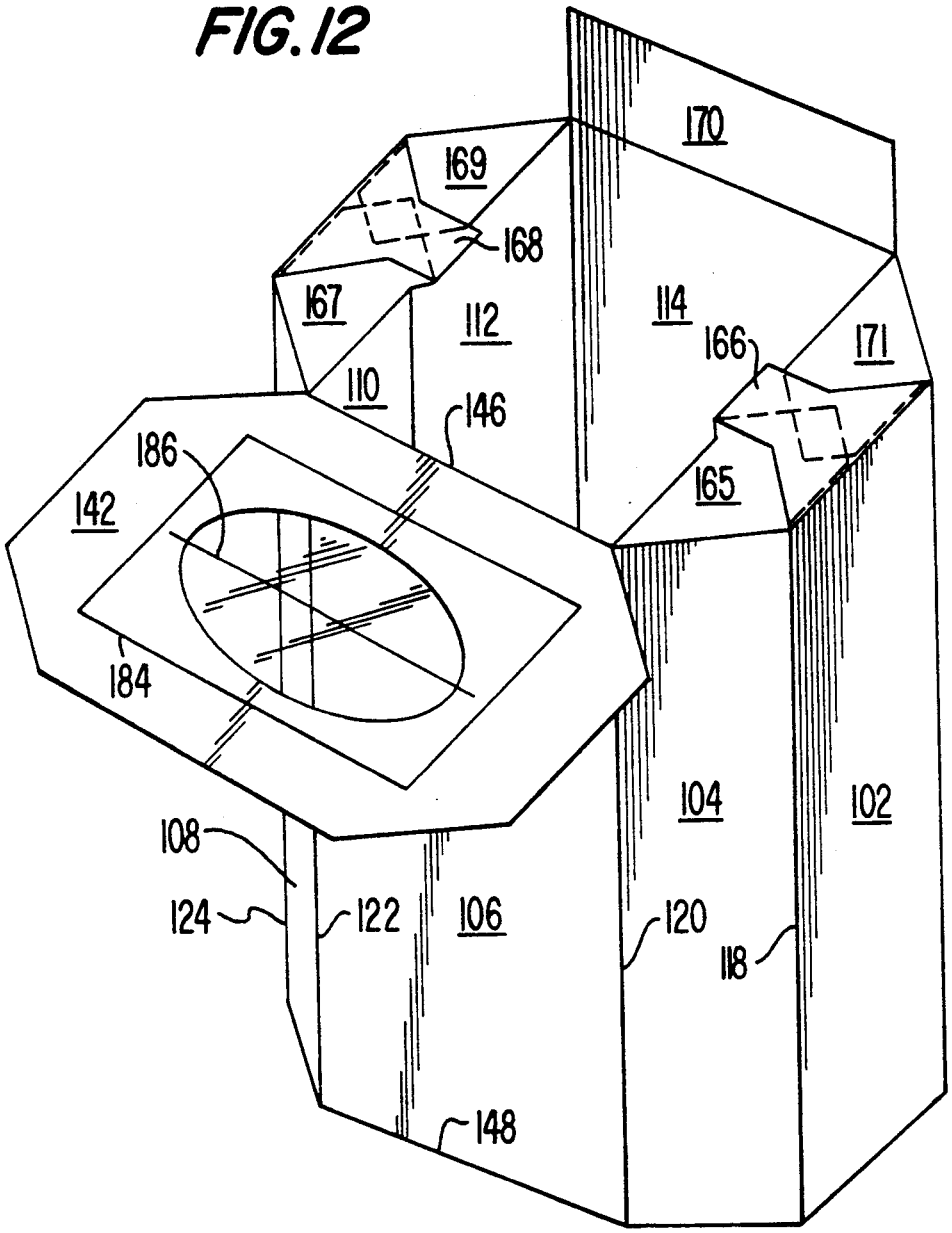
FIG. 12 is a perspective view of the container of FIG. 11 having an open end for receiving facial tissues therein.

As can be further seen from FIGS. 11 and 12, subsequent to the manufacture of the blank illustrated in any of FIGS. 7–9, a thin transparent film 184 may be adhered to an inner surface of the octagonal end panel 142 which covers the entire access opening 136. The thin transparent film 184 further includes a slit 186 which may be either completely or partially formed therein which allows a facial tissue to be removed from the container by the consumer while applying a sufficient retaining force to retain a substantial portion of a successive tissue within the facial tissue container. By providing the slit 186 within the transparent film 184, only a minor portion of the successive tissue will extend through the slit 186 such that the minor portion of the successive tissue may be readily grasped by the consumer when it is desired to remove the subsequent tissue from the container.

Figure 13:
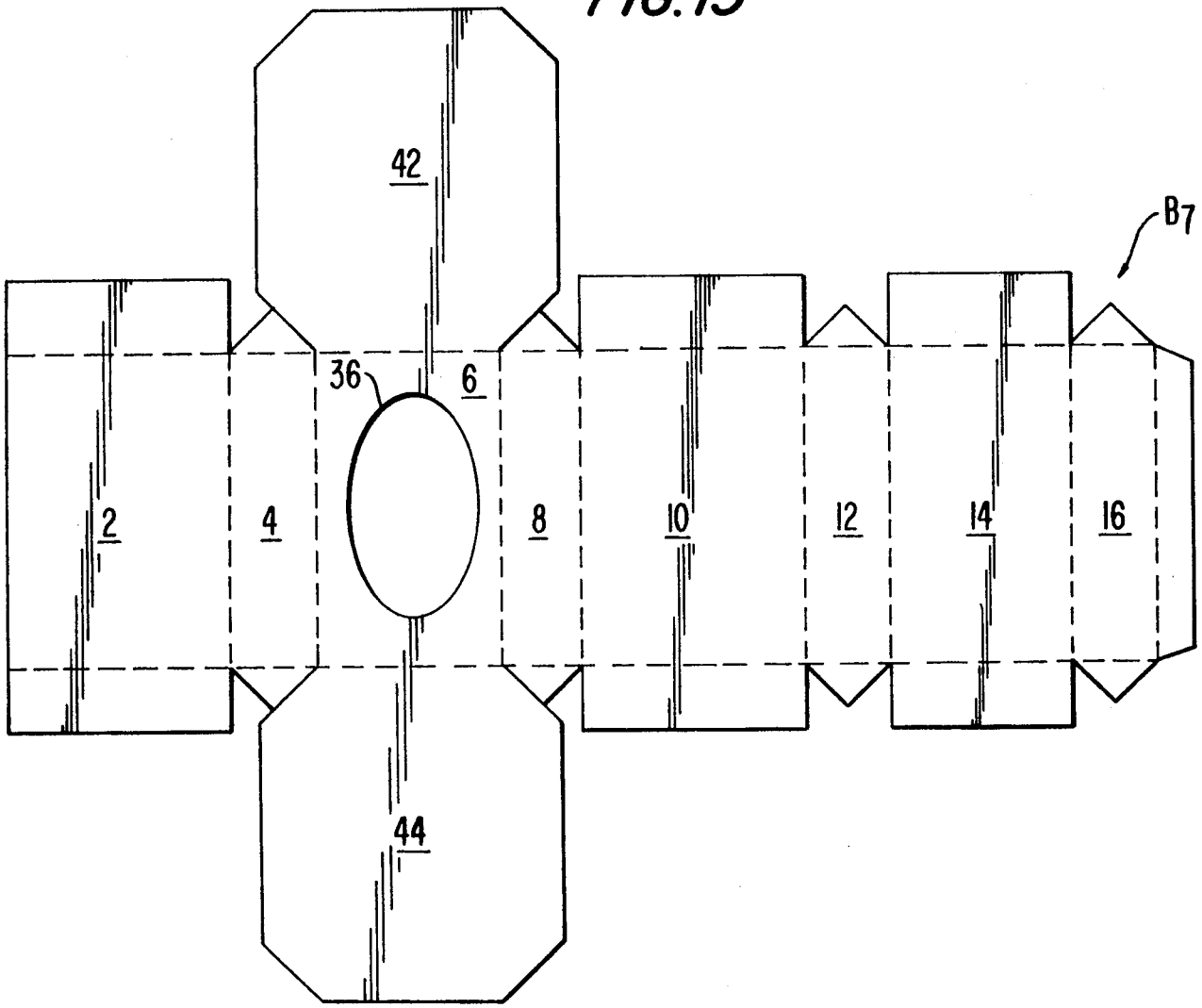
FIG. 13 is a plan view of yet another alternative paperboard blank used in forming the container in accordance with the alternative embodiment of the present invention.

Referring now to FIGS. 13–16, additional embodiments of the present invention will be discussed in greater detail. FIG. 13 illustrates a carton blank $B_7$ which is similar to the blank $B_1$ set forth in FIG. 1 however, the sidewalls 2, 4, 6, 8, 10, 12, 14, and 16 are significantly shorter than those set forth in FIG. 1 and the octagonal end panels 42 and 44 are of a greater height therefore resulting in a taller, more narrow tissue carton. With respect to the access opening 36, this opening may include a removable portion such as that illustrated in FIG. 1 or may be temporarily covered by a transparent material and include an underlying film such as is illustrated in FIGS. 11 and 12.

Figure 14:
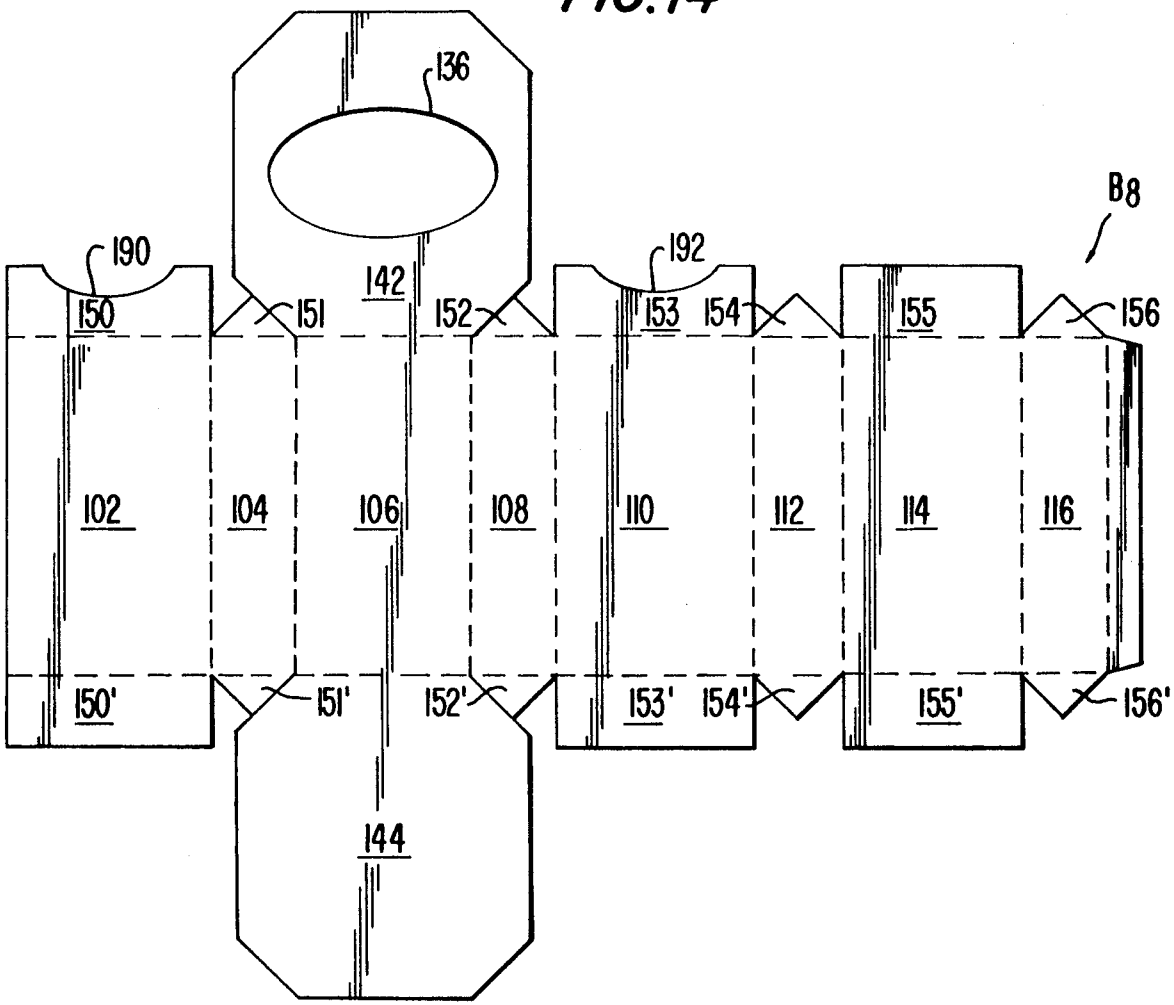
FIG. 14 is a plan view of yet another alternative paperboard blank used in forming the container in accordance with the alternative embodiment of the present invention.

The blank $B_8$ which is illustrated in FIG. 14 is substantially identical to that illustrated in FIG. 7, however, in order to assure that the end panels 150 and 153 do not interfere with the access opening 136 when the carton is formed from the blank $B_8$, cutouts 190 and 192 are formed in the end panels 150 and 153 respectively. Again, the access opening 136 may include a transparent film having a slit therein for gaining access to the tissues within the carton.

Figure 15:
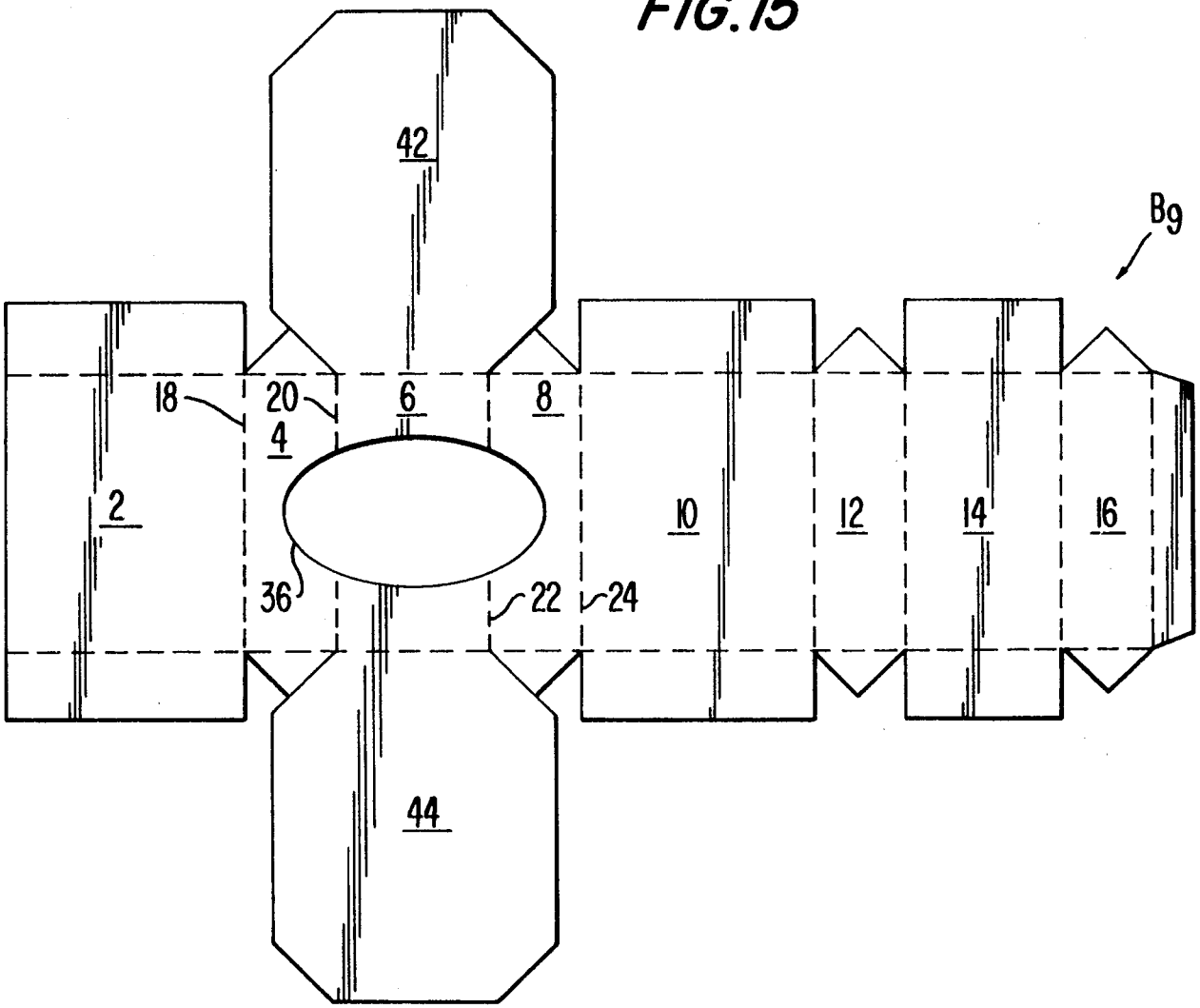
FIG. 15 is a plan view of yet another alternative paperboard blank used in forming the container in accordance with the alternative embodiment of the present invention.

Referring now to FIG. 15, yet another alternative blank configuration is set forth therein. The blank $B_9$ is of a construction similar to that set forth in FIG. 13 with the exception that the access opening 36 has been rotated clockwise 90° such that the major access of the elliptical opening extends in a direction transverse to the crease score fold lines 18, 20, 22, and 24. In doing so, the access opening 36 spans side panels 4, 6, and 8 such that when the blank $B_9$ is formed into a carton, the access opening forms a substantially arcuate opening. Again, access opening 36 may be provided with a transparent film having a slit therein for retaining success tissues within the carton.

Figure 16:
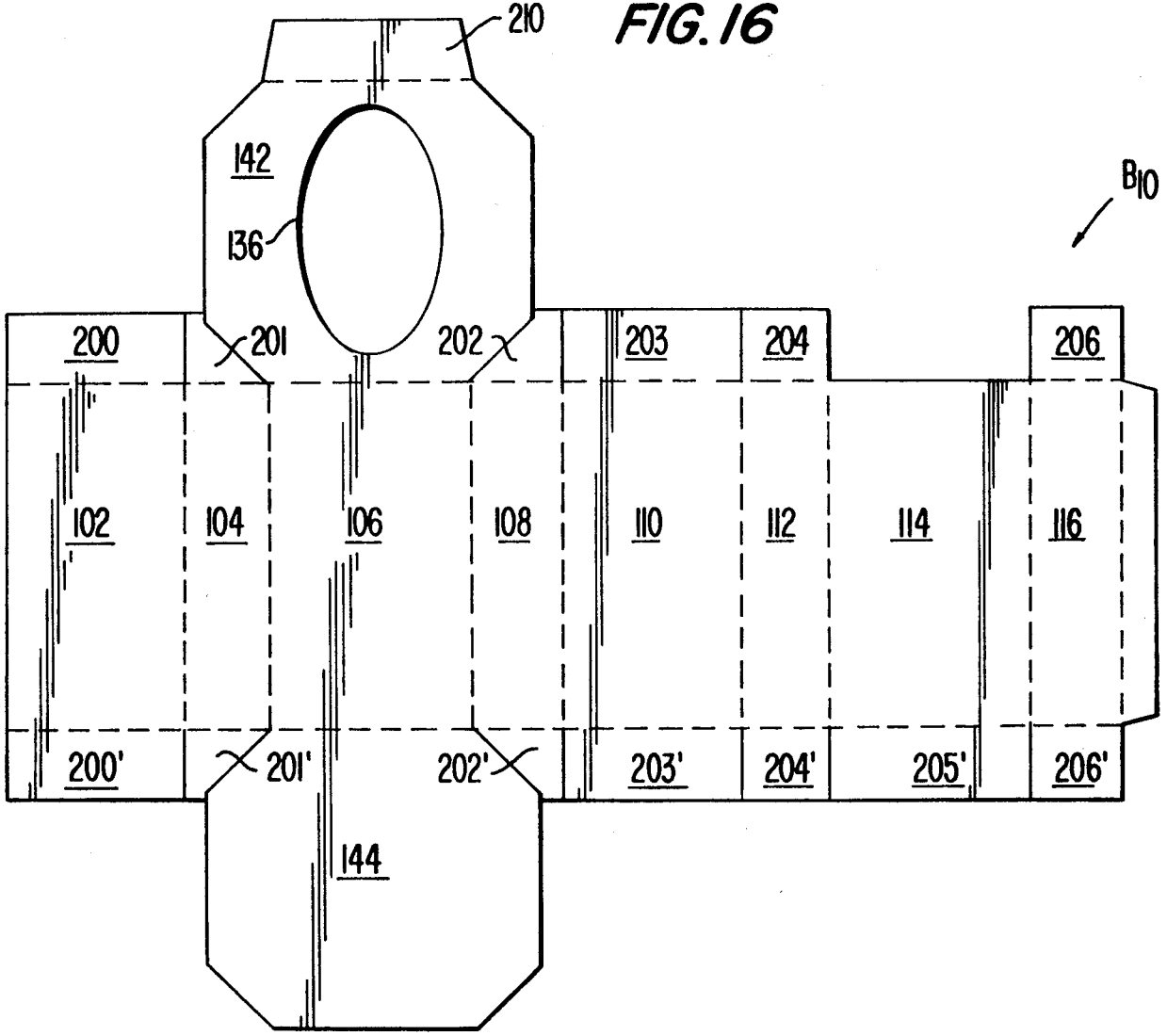
FIG. 16 is a plan view of yet another alternative paperboard blank used in forming the container in accordance with the alternative embodiment of the present invention.

FIG. 16 illustrates yet another alternative embodiment of the present invention wherein blank $B_{10}$ includes sidewalls 102, 104, 106, 108, 110, 112, 114 and 116 as well as octagonal end panels 142 and 144. With the exception of sidewall 114, each of the remaining sidewalls include end panels 200, 201, 202, 203, 204, and 206 while each of the sidewalls include end panels 200'–206'. Unlike the previous embodiments, the octagonal end panel 142 including the access opening 136 also includes a sealing flap 210 which is sealed to an inside surface of the sidewall 114 of the carton formed from the blank $B_{10}$. The sealing flap 210 thus takes the place of one of the end panels of sidewall 114. Again, the access open 136 may include a transparent film having a slit therein for retaining successive tissues within a formed carton.

While the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

INDUSTRIAL APPLICABILITY

The above described facial tissue container may be used not only for light weight facial tissues generally displayed in households, but also, the containers may be manufactured in a variety of sizes in order to accommodate washcloths, facial cloths or other type sheet-like consumer good which may be readily dispensed from a container as set forth hereinabove. The present invention however is particularly suitable for facial tissue containers which are often placed in rather prominent and visible positions to make the contents easily accessible to the consumer.

I claim:

1. A facial tissue container for containing facial tissues to be dispensed therefrom comprising:

a first octagonal end panel;

a second octagonal end panel;

a plurality of side panels extending between said first and second end panels; and an access opening integrally formed in one of said side panels and said end panels for permitting access to the facial tissues therein and for dispensing the facial tissues therethrough;

wherein said first octagonal end panel is integrally connected to a respective one of said side panels and said second octagonal end panel is integrally connected to a respective one of said side panels.

2. The container as defined in claim 1, wherein said plurality of side panels are integrally connected to one another by crease score fold lines with a first of said side panels and a last of said side panels being interconnected to one another by a sealing flap.

3. The container as defined in claim 1, wherein said access opening is formed in one of said side panels and defined by a line of weakness formed in said one of said side panels.

4. The container as defined in claim 3, wherein said one of said side panels including said access opening is a top panel of said container.

5. The container as defined in claim 4, wherein said top panel and one of said side panels opposing said top panel are of a width greater than a width of remaining of said side panels.

6. The container as defined in claim 4, wherein said octagonal end panels are integrally connected to ends of said top panel along crease score lines and respective remaining side panels include end flaps integrally connected to ends of each of the respective remaining side panels along crease score lines such that said octagonal end panels overlie and are adhesively secured to said end flaps.

7. The container as defined in claim 1, wherein said access opening is formed in one of said first and second octagonal end panels.

8. The container as defined in claim 7, wherein said end panel including said access opening is a top panel of the container.

9. The container as defined in claim 8, wherein said access opening is defined by a cut-out section of said end panel including said access opening.

10. The container as defined in claim 9, further comprising a retaining means for retaining subsequent tissues within said container upon removal of an uppermost tissue from said container.

11. The container as defined in claim 10, wherein said retaining means is a thin transparent film underlying said cut-out section, said film including an opening formed therein for permitting removal of the uppermost tissue from said container.

12. The container as defined in claim 7, wherein said octagonal end panels are integrally connected to ends of said top panel along crease score lines and respective remaining side panels include end flaps integrally connected to ends of each of the respective remaining side panels along crease score lines such that said octagonal end panels overlie and are adhesively secured to said end flaps.

13. A blank for forming a facial tissue container comprising:

a plurality of side panels integrally connected to one another by substantially parallel crease score lines;

first and second octagonal end panels integrally connected to respective ends of one of said side panels by crease score lines;

a plurality of end flaps integrally connected to respective ends of the remaining side panels; and an access opening integrally formed in one of said side panels and said end panels for permitting access to facial tissues within the facial tissue container formed from the blank.

14. The blank as defined in claim 13, further comprising a sealing flap integrally connected to one of said side panels along a crease score line, said sealing flap being adapted to adhere to an inside surface of another of said side panels to form a substantially cylindrical container.

15. The blank as defined in claim 13, wherein said access opening is formed in one of said side panels and defined by a line of weakness formed in said one of said side panels.

16. The blank as defined in claim 15, wherein said one of said side panels including said access opening forms a top panel of the facial tissue container formed from the blank.

17. The blank as defined in claim 16, wherein said one of said side panels which forms said top panel and an opposing one of said side panels which opposes said top panel when the facial tissue carton is formed from the blank are of a greater width than a width of remaining of said side panels.

18. The blank as defined in claim 13, wherein said access opening is formed in one of said first and second octagonal end panels.

19. The blank as defined in claim 18, wherein said end panel including said access opening forms a top panel of the facial tissue container formed from the blank.

20. The blank as defined in claim 19, wherein said access opening is defined by a cut-out section of said end panel including said access opening.

21. The blank as defined in claim 17, wherein said first and second octagonal end panels are integrally connected to said top panel, and a third octagonal end panel and a fourth octagonal end panel are integrally connected to respective ends of said opposing one of said side panels by crease score lines.

* * * * *